US006331123B1

(12) United States Patent
Rodrigues

(10) Patent No.: US 6,331,123 B1
(45) Date of Patent: Dec. 18, 2001

(54) CONNECTOR FOR HARD-LINE COAXIAL CABLE

(75) Inventor: Julio F. Rodrigues, Collier, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/902,994

(22) Filed: Jul. 11, 2001

Related U.S. Application Data

(63) Continuation of application No. 09/716,667, filed on Nov. 20, 2000.

(51) Int. Cl.[7] ..... H01R 9/05
(52) U.S. Cl. ..... 439/584
(58) Field of Search ..... 439/584, 585, 439/578, 387

(56) References Cited

U.S. PATENT DOCUMENTS

| | | | |
|---|---|---|---|
| 3,336,563 | 8/1967 | Hyslop | 439/603 |
| 3,474,391 | 10/1969 | Gartzke et al. | 439/462 |
| 3,541,495 | 11/1970 | Ellis et al. | 439/578 |
| 3,706,958 | 12/1972 | Blanchenot | 439/584 |
| 3,744,011 | 7/1973 | Blanchenot | 439/584 |
| 3,764,959 | 10/1973 | Toma et al. | 439/584 |
| 3,847,463 | 11/1974 | Hayward et al. | 439/28 |
| 4,346,958 | 8/1982 | Blanchard | 439/584 |
| 4,408,822 | 10/1983 | Nikitas | 439/583 |
| 4,452,503 | 6/1984 | Forney, Jr. | 439/585 |
| 4,469,390 | 9/1984 | LeVine et al. | 439/394 |
| 4,540,231 | 9/1985 | Forney, Jr. | 439/306 |
| 4,583,811 | 4/1986 | McMills | 439/584 |
| 4,614,390 | 9/1986 | Baker | 439/592 |
| 4,648,684 | 3/1987 | Mattis et al. | 439/585 |
| 4,674,818 | 6/1987 | McMills et al. | 439/275 |
| 4,717,355 | 1/1988 | Mattis | 439/452 |
| 4,834,675 | 5/1989 | Samchisen | 439/578 |
| 4,834,676 | 5/1989 | Tackett | 439/584 |
| 4,854,893 | 8/1989 | Morris | 439/578 |
| 4,902,246 | 2/1990 | Samchisen | 439/578 |
| 4,921,447 | 5/1990 | Capp et al. | 439/585 |
| 4,952,174 | 8/1990 | Sucht et al. | 439/584 |
| 4,993,964 | 2/1991 | Trummer | 439/272 |
| 5,002,503 | 3/1991 | Campbell et al. | 477/8 |
| 5,011,432 | 4/1991 | Sucht et al. | 439/584 |
| 5,137,471 | 8/1992 | Verespej et al. | 439/585 |
| 5,194,012 | 3/1993 | Cairns | 439/201 |
| 5,195,906 | 3/1993 | Szegda | 439/394 |
| 5,232,377 | 8/1993 | Leibfried, Jr. | 439/320 |
| 5,284,449 | 2/1994 | Vaccaro | 439/583 |
| 5,295,864 | 3/1994 | Birch et al. | 439/578 |
| 5,342,218 | 8/1994 | McMills et al. | 439/578 |
| 5,352,134 | 10/1994 | Jacobsen et al. | 439/584 |
| 5,393,244 | 2/1995 | Szegda | 439/394 |
| 5,470,257 | 11/1995 | Szegda | 439/578 |
| 5,632,651 | 5/1997 | Szegda | 439/578 |
| 5,651,698 | 7/1997 | Locati et al. | 439/578 |
| 5,746,623 | 5/1998 | Fuchs et al. | 439/623 |
| 5,769,662 | 6/1998 | Stabile et al. | 439/578 |
| 5,800,211 | 9/1998 | Stabile et al. | 439/578 |
| 5,879,191 | 3/1999 | Burris | 439/584 |
| 5,997,350 | 12/1999 | Burris et al. | 439/585 |
| 6,019,636 | 2/2000 | Langham | 439/584 |
| 6,102,738 | 8/2000 | Macek et al. | 439/584 |

*Primary Examiner*—Tulsidas Patel
(74) *Attorney, Agent, or Firm*—Hoffman & Baron, LLP

(57) ABSTRACT

The connector of the present invention provides an environmentally sealed connector for terminating a coaxial cable. The connector is useful with hard-line or semi-rigid coaxial cables.

31 Claims, 8 Drawing Sheets

CONNECTOR FOR HARD-LINE COAXIAL CABLE

CROSS-REFERENCE TO RELATED APPLICATIONS

The present application is a continuation of U.S. Ser. No. 09/716,667, filed Nov. 20, 2000.

FIELD OF THE INVENTION

The present invention relates to electrical connectors and more particularly to axially compressible connectors for hard-line or semi-rigid coaxial cables.

DESCRIPTION OF RELATED TECHNOLOGY

Coaxial cables are commonly used in the cable television industry to carry cable TV signals to television sets in homes, businesses, and other locations. A hard-line coaxial cable may be used to carry the signals in distribution systems exterior to these locations and a flexible coaxial cable is then often used to carry the signals within the interior of these locations. Hard-line or semi-rigid coaxial cable is also used where a high degree of RF shielding is required.

The hard-line cable includes a solid wire core or inner conductor, typically of copper or copper-clad aluminum, surrounded by a solid tubular outer conductor. The outer conductor is usually made of copper or aluminum. Dielectric material or insulation separates the inner and outer conductors. The outer conductor is covered with a cable jacket or sheath of plastic to provide protection against corrosion and weathering.

One type of connector for semi-rigid coaxial cables includes direct solder attachment of the connector to the outer conductor of the cable. See, for example, U.S. Pat. Nos. 4,921,447 and 5,232,377. The solder attachment provides, in part, mechanical attachment of the connector to the outer conductor. Such direct solder attachment, however, has often been a production problem because of the complex equipment required for soldering and the difficulty in operating complex equipment.

Another type of cable connector for hard-line cable employs radial compression crimping to electrically and mechanically connect parts of the connector to the cable. Typically, a sleeve within the connector is compressed by a crimping tool. The sleeve may have slots, flutes, threads and the like to assist in the mechanical connection between the sleeve and the outer conductor of the cable. See, for example, U.S. Pat. Nos. 4,408,821; 4,469,390; 5,120,260 and 6,042,422. The radial crimping, however, often does not apply compressive force evenly to the outer conductor or alternatively to outer tubular jacket of the outer connector. Such uneven compression can form channels for infiltration of moisture into the coaxial cable connection and consequently leading to the degradation of the signal carried by the cable.

Threaded cable connectors have been employed to provide more even compression of the connector. See, e.g., U.S. Pat. Nos. 5,352,134 and 6,019,636. Threaded connectors, however, are often more time consuming to install because of the turning motion required to complete the threaded connection. Furthermore, an installer of threaded connectors must often carry many different sized wrenches to accommodate the different sized cable connectors, which also complicated the installation process.

To overcome the difficulties of crimped and threaded connectors different designs of axially compressible connectors have been employed. U.S. Pat. Nos. 4,408,821 and 4,452,503 disclose a connector a grooved tubular sleeve that radially compresses a grip ring upon axial compression of the connector. The grip ring has spline fingers that furrow into the outer conductor and longitudinal slots that interlock with the outer conductor. Such an arrangement does, however, mechanically deform the outer conductor which can lead to signal loss. Furthermore, the design does not adequately guard against moisture from entering the connector because the entire circumferential surface of the outer conductor is not necessarily engaged with the grip ring. An attempt to provide a better sealing mechanism in related application, U.S. Pat. No. 4,540,231, employed glue to provide a seal. The use of glue, however, further complicated the installation and construction of such a connector.

U.S. Pat. Nos. 4,596,434 and 4,668,043 disclose a tubular housing with interior teeth which is radially compressed by a bushing upon axial compression of the connector which forces a coupling nut onto the bushing. The teeth furrow into the outer conductor to provide a mechanical and electrical connection thereat. The bushing may also contain an o-ring which acts as a seal between the bushing and the outer conductor. Such designs, however, still require significant mechanical deformation of the outer conductor which can lead to signal loss.

U.S. Pat. No. 4,834,676 discloses a ferrule with interior barbs and a longitudinal slot. The barbs deform the outer conductor upon compression of the ferrule by a tool to axially compress the connector. This design depends upon the longitudinal slot being substantially closed after compression of the ferrule to provide a seal for the connector. Such a design, however, is not effective against moisture leakage.

As such there is a need for an easy-to-connect connector for hard-line cables that is simpler to connect and provides suitable mechanical and electrical connections. Furthermore, there is a need to provide a connector for a hard-line cable that provides an effective seal against moisture leakage from the external environment without substantial deformation of the outer conductor of the coaxial cable.

SUMMARY OF THE INVENTION

The present invention provides a quick connect, environmentally sealed connector for hard-line or semi-rigid coaxial cables. The connector includes a seal ring and a sleeve, with a sealing device. Upon axial compression of the connector to close and secure the connector to the coaxial cable, the seal ring and the sleeve slidingly engage and force the sealing device towards the outer cable jacket of the coaxial cable to provide an environmentally sealed portion thereof.

In one aspect of the present invention the sleeve contains a circumferential slot at the sleeve's distal end, which end is proximal to the seal ring. Upon axial compression of the connector, the sleeve and the seal ring slidingly engage to force an inner portion of the sleeve's distal end onto the cable jacket to environmentally seal the connector thereat.

In another aspect of the present invention the sleeve contains a notch at its distal end and an o-ring positioned within the notch. Upon axial compression of the connector, the sleeve and the seal ring slidingly engage to compress the o-ring onto the cable jacket and form an environmental seal thereat.

Upon axial compression of the connector, the sleeve's proximal end, which is opposite to the distal end, slidingly engages a ferrule having parted fingers. The ferrule fingers compress radially inward to secure the ferrule to the outer conductor of the coaxial cable. The connector also includes a post which prevents collapse of the outer conductor upon compression of the ferrule.

The post, the ferrule and the sleeve are generally contained within a collar of the connector. Upon axial compression to close the connector, an environmental seal is formed between the sleeve and the collar to prevent migration of moisture thereat.

In yet another aspect of the present invention an environmentally sealed connector for hard-line or semi-rigid coaxial cables is provided. The connector includes o-rings to provide environmental seals upon securement of the connector to the coaxial cable. One o-ring is positioned within a notch of a cylindrical sleeve. This o-ring engages onto a cable jacket of the coaxial cable to form an environmental seal thereat. Upon securement of the connector to the coaxial cable, the sleeve engages a parted ferrule. The parted ferrule compresses radially inward to secure the ferrule to an outer conductor of the coaxial cable. The connector also includes a post which prevents collapse of the outer conductor upon compression of the ferrule. Upon securement of the connector to the coaxial cable, an environmental seal is also formed between the cylindrical seal and the collar to prevent migration of moisture thereat.

DETAILED DESCRIPTION

The present invention is directed towards a connector for hard-line or semi-rigid coaxial cables. The connector is configured to be axially compressible about a hard-line coaxial cable to provide mechanical and electrical connections for the coaxial cable. Furthermore, upon axial compression the connector environmentally seals the coaxial cable to guard against moisture leakage which can adversely effect the performance of the coaxial cable.

Figure 1:
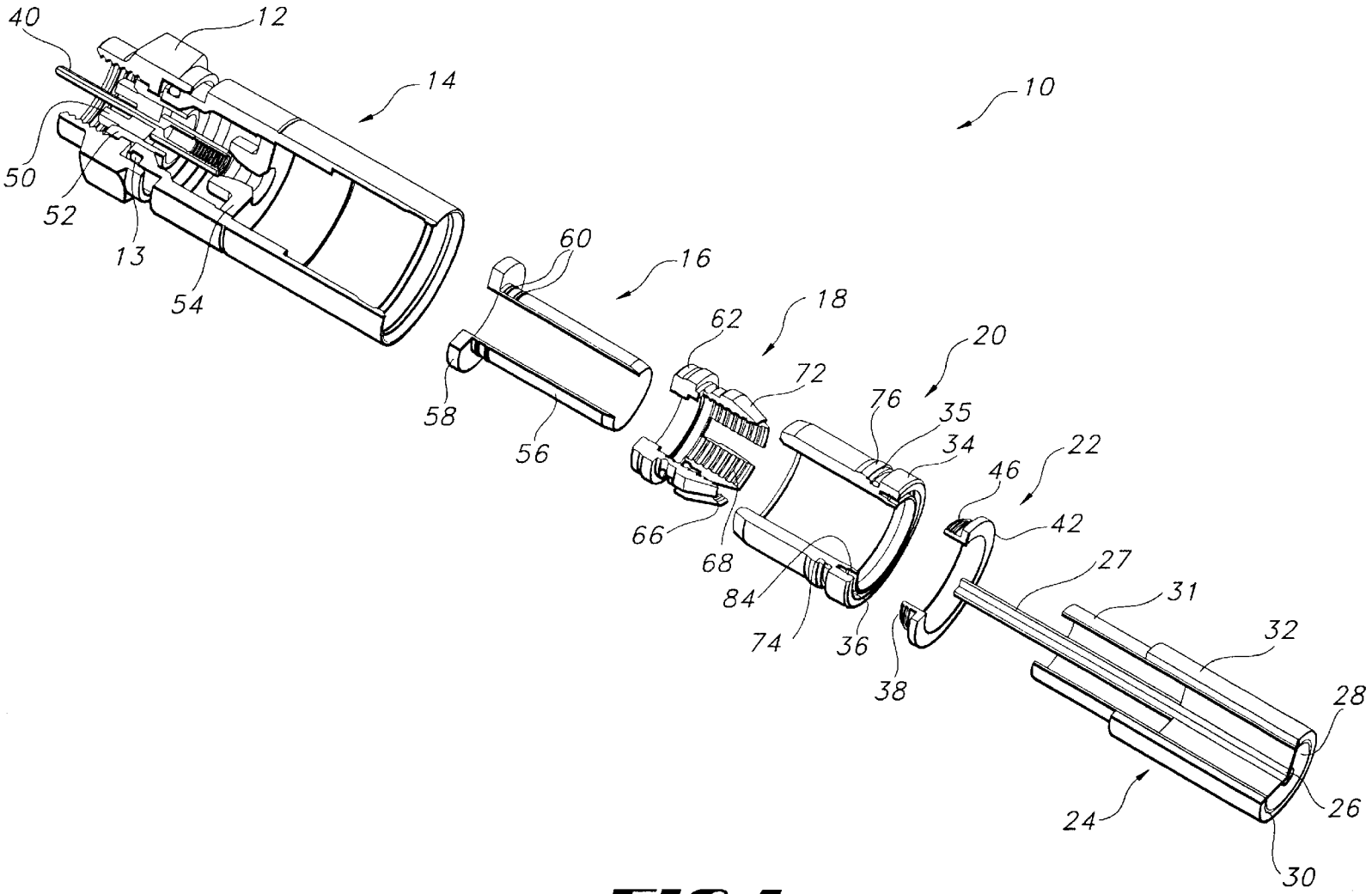
FIG. 1 is a partial cutaway perspective view of the connector of the present invention.

FIG. 1 depicts a partial cutaway, perspective view of connector 10 of the present invention. Connector 10 includes seal nut 12, collar 14, post 16, ferrule 18, sleeve 20 and seal ring 22, inter-related as shown. Connector 10 is a quick connect RF connector for use with a hard-line coaxial cable 24 and closes upon axial compression.

Coaxial cable 24 includes an elongate cable center conductor 26 capable for providing electrical signals therethrough. Center conductor 26 is typically formed from a conductive metal, such as copper, copper clad aluminum, copper clad steel and the like. Surrounding the cable center conductor 26 is a cable dielectric 28 which insulates the cable center conductor 26 to minimize signal loss. The cable dielectric 28 also maintains a spacing between the cable center conductor 26 and a cable outer conductor 30. The cable dielectric 28 is often a plastic material, such as a polyethylene, a fluorinated plastic material, such as a polyethylene, a fluorinated plastic material, such as a polytetrafluoroethylene, a fiberglass braid and the like. The cable outer conductor 30 is typically a metal, such as aluminum or steel, and is often extruded to form a hollow tubular structure with a solid wall having a smooth exterior surface. Cable jacket 32 surrounds the cable outer conductor 30 to further seal the coaxial cable 24 and is typically a plastic, such as polyvinylchloride, polyethylene, polyurethane, polytetrafluoroethylene and the like.

As depicted in FIG. 1 a portion of the cable jacket 32, the cable outer conductor 30 and the cable dielectric 28 is removed from a proximal end of coaxial cable 24. As used herein, proximal refers to a general direction longitudinally towards pin terminal 40, and distal refers to a general direction longitudinally away from pin terminal 40. Upon axial compression of connector 10, the exposed portion 27 of cable center conductor 26 is slidably engaged with the pin terminal 40. Pin terminal 40 is secured within seal nut 12 by pin support 50 and stem 52 and secured within collar 14 by closing collar 54. An o-ring 13 provides an environmental seal between the seal nut 12 and the collar 14. Moreover, portions of the cable jacket 32 and the cable dielectric 28 are further removed from the proximal end of coaxial cable 24 to provide an exposed portion 31 of cable outer conductor 30.

Figure 2A:
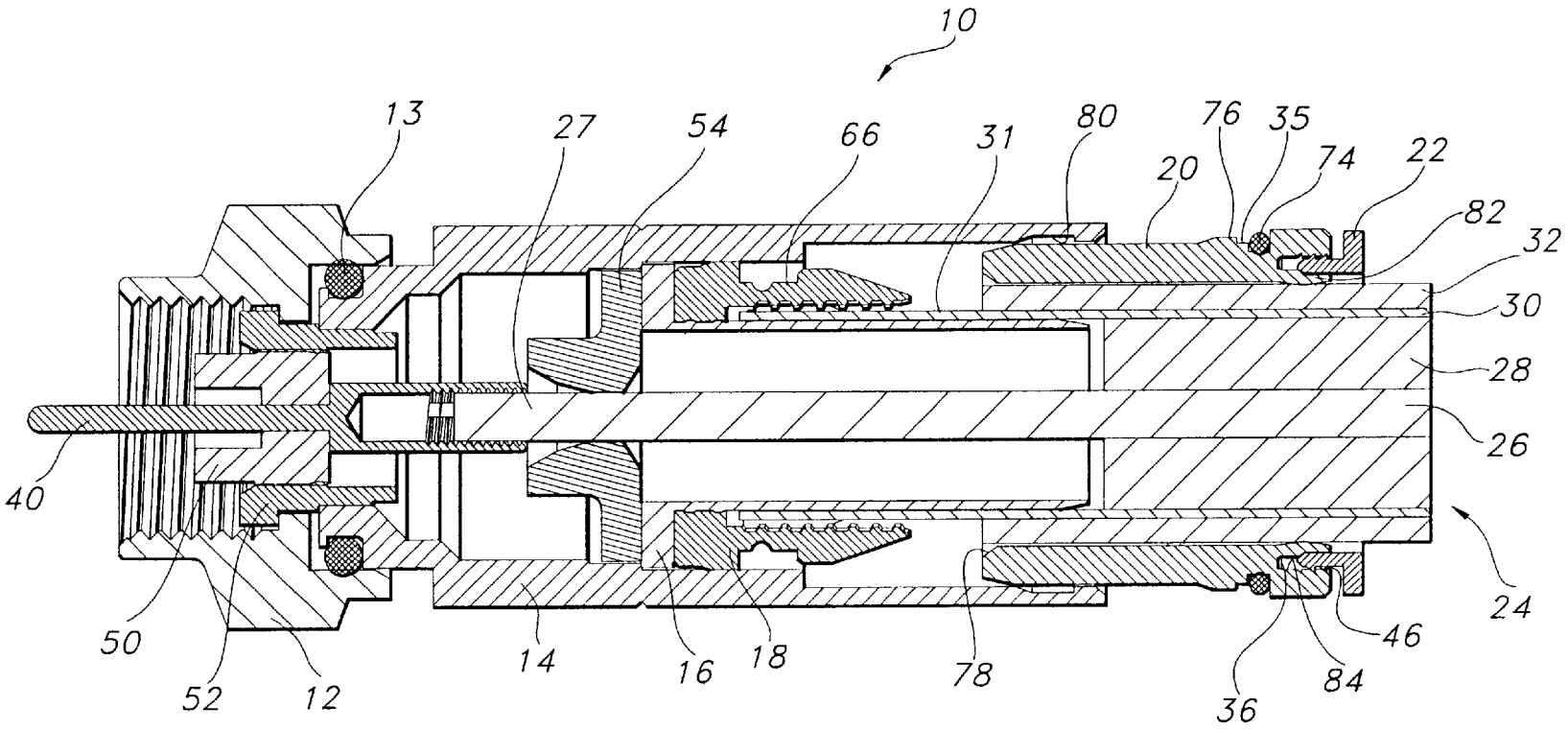
FIG. 2A is a cross-sectional view of the connector of FIG. 1 in an open position.
Figure 3B:
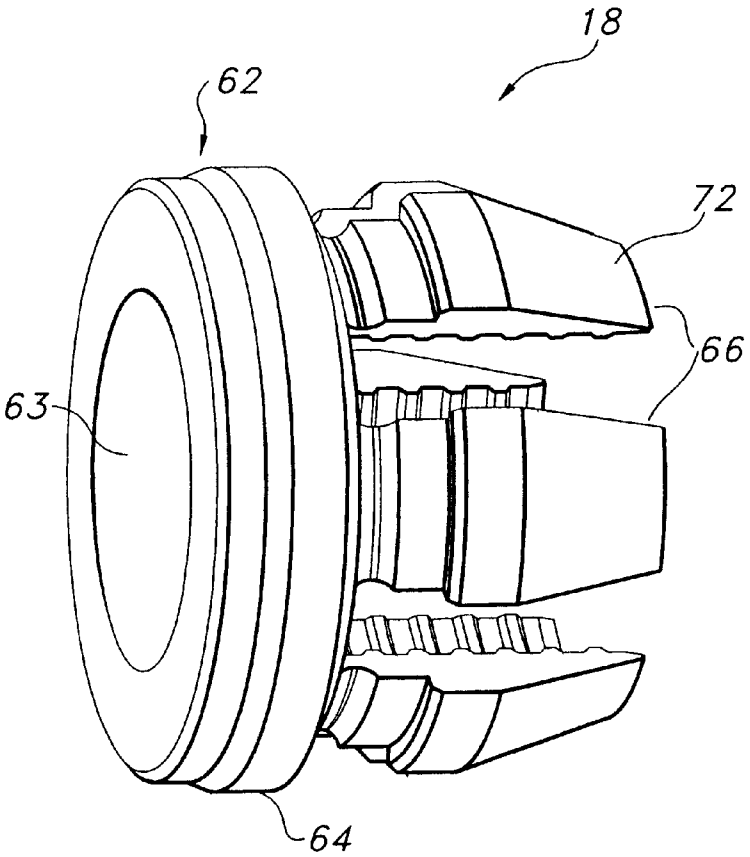
FIG. 3B is an alternate perspective view of the ferrule of FIG. 1.
Figure 3A:
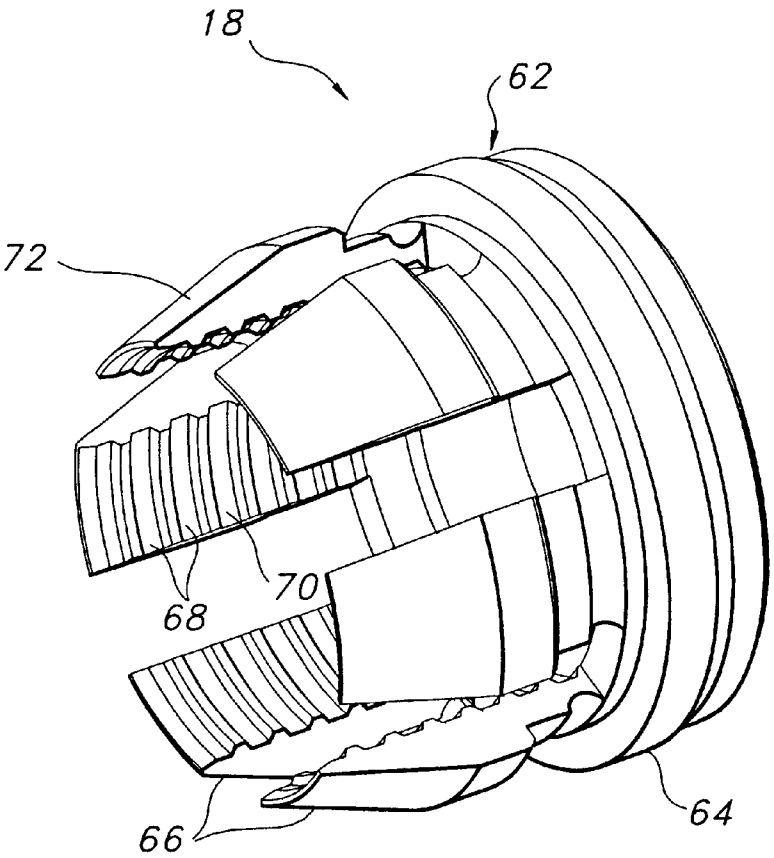
FIG. 3A is a perspective view of a ferrule of the connector of FIG. 1.

The post 16 has an elongate tubular portion 56 adapted to engage an inner wall of the exposed portion 31 of the cable outer conductor 30. The post 16 has a flange 58 at the proximal end thereof and has ridges 60 at the proximal end of the elongate tubular portion 56. Post 16 comprises a conductive metal, such as aluminum or brass. As depicted in FIG. 2A which is a cross-sectional view of connector 10 in an open position, the flange 58 and the ridges 60 are configured to secure ferrule 18 within collar 14, FIGS. 3A and 3B are perspective views of ferrule 18. Ferrule 18 has a hollow tubular flange 62 at the proximal end thereof. The interior portion 63 of flange 62 is configured to abuttingly engage the ridges 60 of past 16. An exterior portion 64 of flange 62 is configured to abuttingly engage an interior portion of collar 14.

Ferrule 18 has a plurality of parted fingers 66. Parted fingers 66 have a plurality of inwardly projecting ridges 68 extending circumferentially from interior portions 70. Desirably, the ridges 68 are inwardly projecting threads. As described in further detail hereinafter in conjunction with FIG. 2B, ridges 68 are configured to securably engage the exposed portion 31 of the cable outer conductor 30. Furthermore, parted fingers 66 have a slanted surface 72 that provide a distal tapering of parted fingers 66. Ferrules 18 comprise a conductive metal, such as aluminum or brass.

Sleeve 20 is an elongate hollow tubular cylinder made of a deformable material, such as a plastic material. Useful plastic materials include acetal resins such as polyoxymethylene type acetal resins, such as Derlin® available from DuPont de Nemours and Co. The distal portion 34 of sleeve 20 has an annularly shaped slot 36 extending longitudinally into the wall of the distal portion 34. Slot 36 is configured to receive the proximal end 38 of seal ring 22 and is further described below in conjunction with FIGS. 2A and 2B.

Figure 2B:
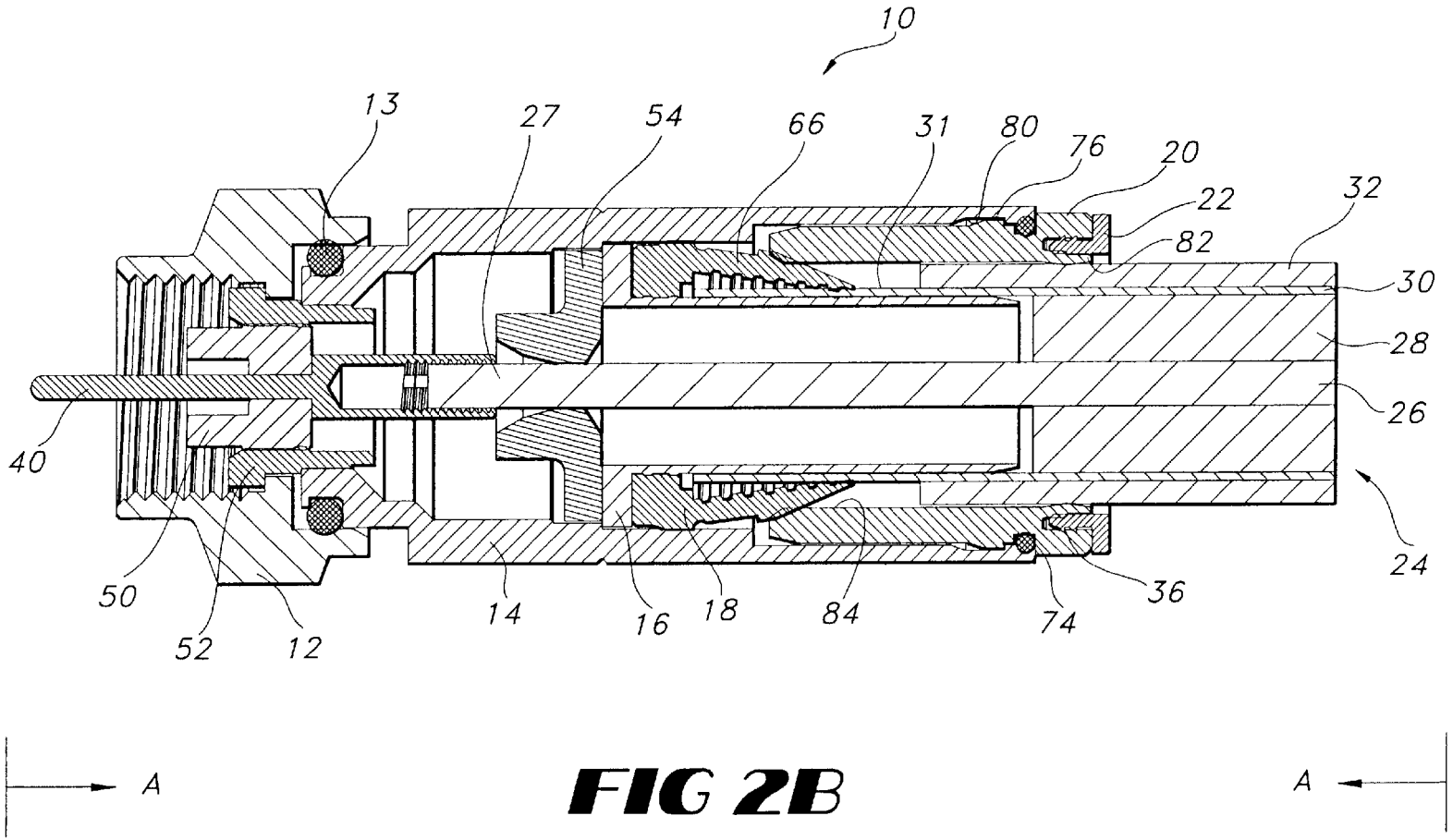
FIG. 2B is a cross-sectional view of the connector of FIG. 1 in a closed position.

As depicted in FIGS. 2A and 2B, adjacent to the distal portion 34 of sleeve 20 is a circumferentially extending indentation 35 which is adapted to hold an o-ring 74. O-ring 74 comprises a resilient material, such as a synthetic rubber, an elastomeric polymer or a deformable plastic. Adjacent to the indentation 35 is an outwardly projecting protuberance 76 which is configured to secure sleeve 20 within collar 14 upon closing of the connector 10. The proximal end of sleeve 20 is tapered from both the inner and outer surfaces of the sleeve 20. The tapered inner surface 78 of sleeve 20 is designed to slidingly engage the slanted surface 72 of parted fingers 66 of ferrule 18.

Figure 4B:
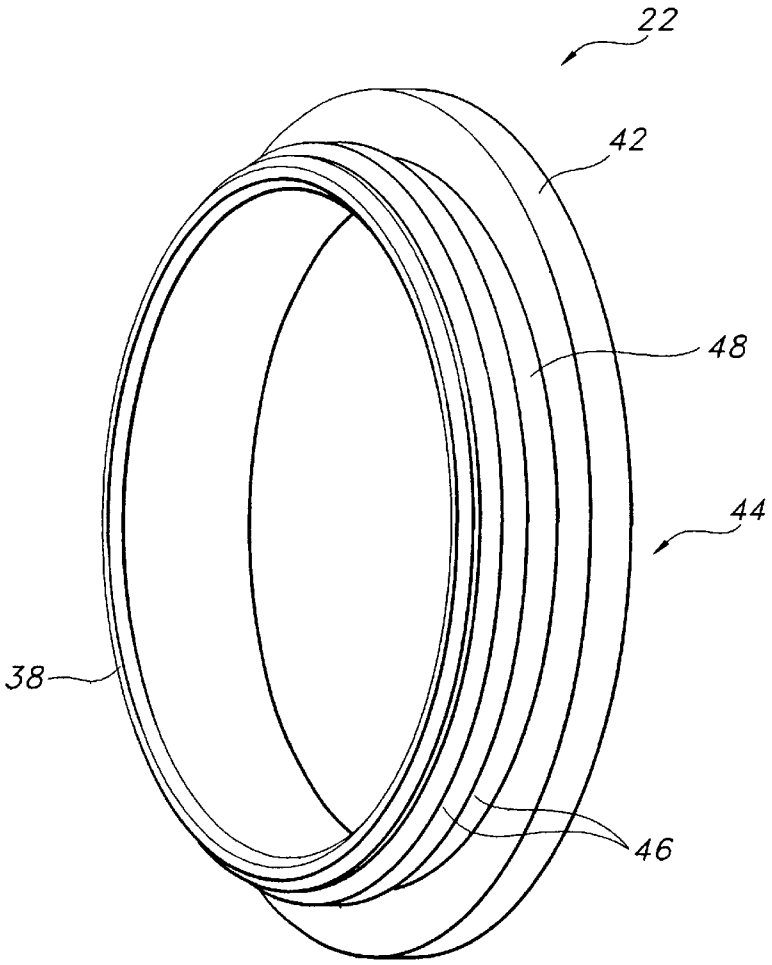
FIG. 4B is an alternate perspective view of the sealing ring of FIG. 1.
Figure 4A:
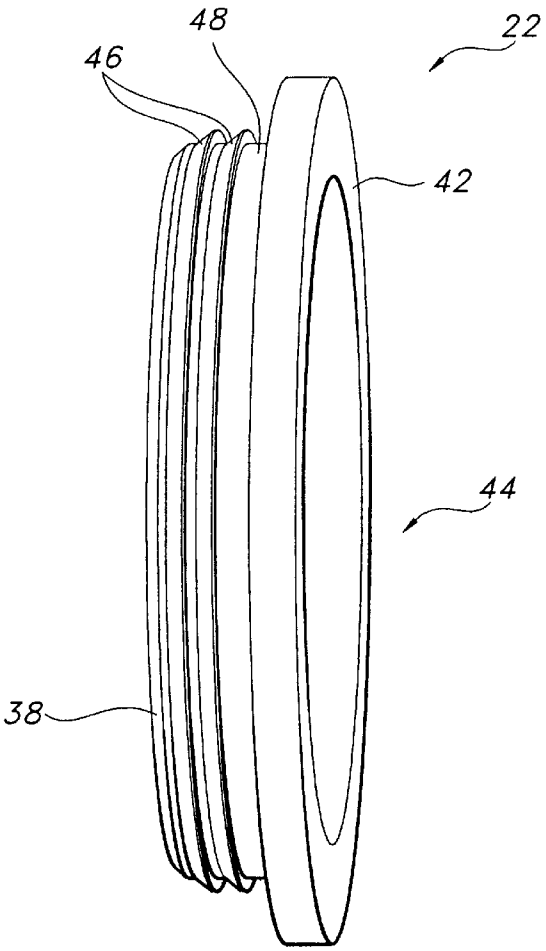
FIG. 4A is a perspective view of a sealing ring of the connector of FIG. 1.

FIGS. 4A and 4B are perspective views of the seal ring 22, which has a hollow bore therethrough. The distal end 44 of the seal ring 22 has a flange 42 thereat. The proximal portion 38 of the seal ring 22 has circumferentially extending ribs 46 extending outwardly from the outer wall 48. Desirably, the ribs 46 are outwardly projecting threads. The seal ring 22 is desirably made from a metal, such as aluminum or brass. The seal ring 22 fits into a cavity in sleeve 20 and the ribs 46 secure the seal ring 22 thereat.

As depicted in FIG. 2A, which is a cross-sectional view of connector 10 in an open position, coaxial cable 24 is placed within connector 10. The exposed cable conductor 27 is placed within pin terminal 40. The exposed portion 31 of cable outer conductor 30 is positioned between post 16 and ferrule 18. Post 16 supports the exposed portion 31 of outer cable conductor 30 to inhibit substantial deformation of the outer cable conductor 30 upon closure of the connector 10. The proximal end of sleeve 20 is positioned within the distal end of collar 14.

A tool (not shown) may be used to axially compress the connector 10 to close and seal the connector 10. As depicted in FIG. 2B, upon axial compression, which is indicated by vector A—A, of connector 10, the tapered inner surface 76 of sleeve 20 slidingly engages the slanted surfaces 72 of ferrule 18. The sliding engagement compress the parted fingers 66 of ferrule 18 inwardly whereupon the ridges 68 abut the exposed portion 27 of the cable outer conductor 26 to fixably secure the cable outer conductor 26 between the post 16 and the ferrule 18.

Moreover, upon axial compression of the connector 10, the distal portion of collar 14 slidingly engages the distal portion 34 of sleeve 20 to compress o-ring 74 to environmentally seal connector 10 thereat. The protuberance 76 of sleeve 20 slidingly engages notch 80 which circumferentially extends along the inner portion of the distal portion of collar 14. This sliding engagement of protuberance 76 and the notch 80 securably attaches sleeve 20 to collar 14.

Furthermore, upon axial compression of connector 10, the proximal end 38 of seal ring 22 slidingly inserts into the annularly shaped slot 36 of sleeve 20 until the distal portion 34 of sleeve 20 abuttingly engages the flange 42 at the distal end 44 of the seal ring 22. Flange 42 serves as a stop to limit the movement of seal ring 22 into sleeve 20. The engagement of seal ring 22 into sleeve 20 inwardly forces in a circumferentially manner an inner portion 82 of the distal portion 34 of sleeve 20 onto the cable jacket 32 to environmentally seal connector 10 thereat. The ribs 46 of seal ring 22 engage an inner surface 84 of the annularly shaped slot 36 of sleeve 20 to secure the seal ring 22 within the sleeve 20.

Figure 5A:
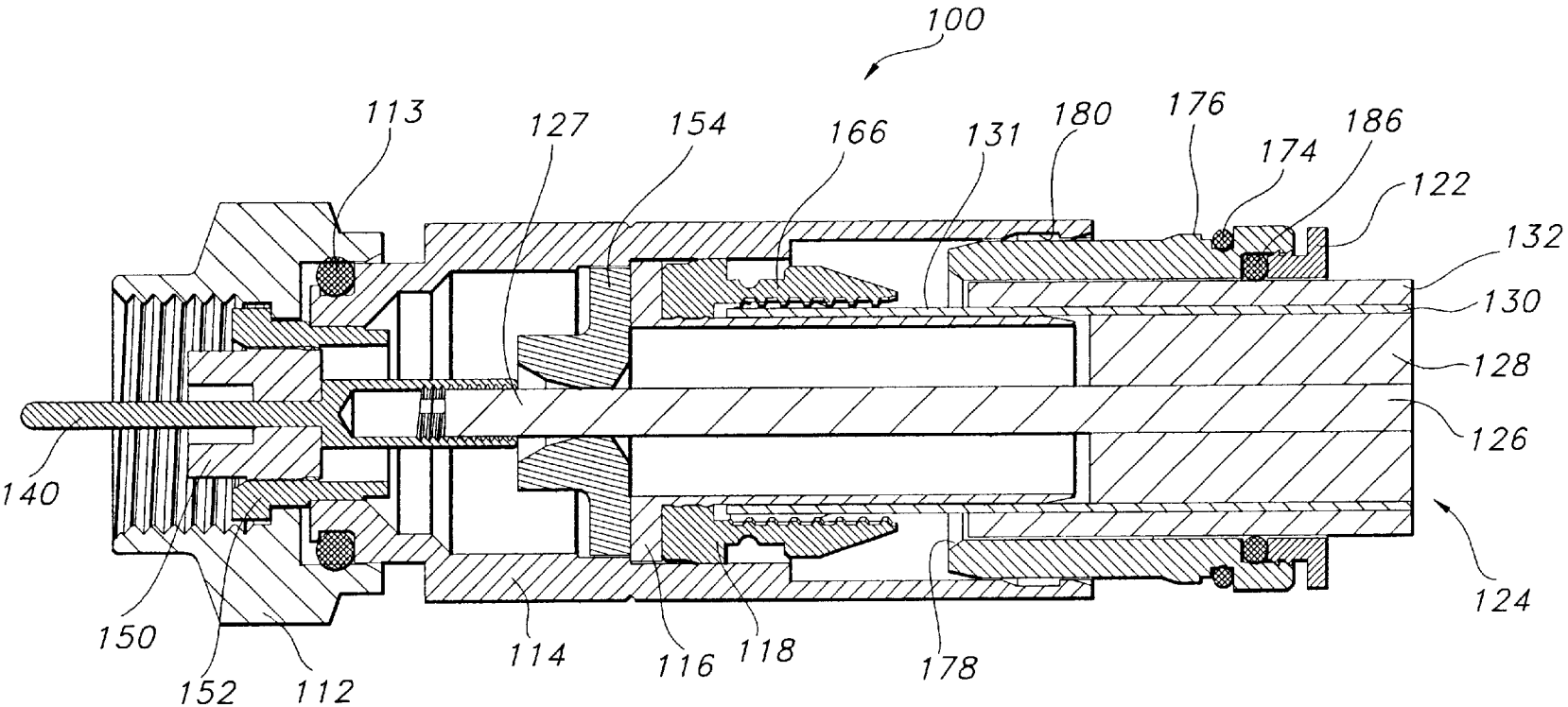
FIG. 5A is a cross-sectional view of a second embodiment of the connector of the present invention in an open position.
Figure 5B:
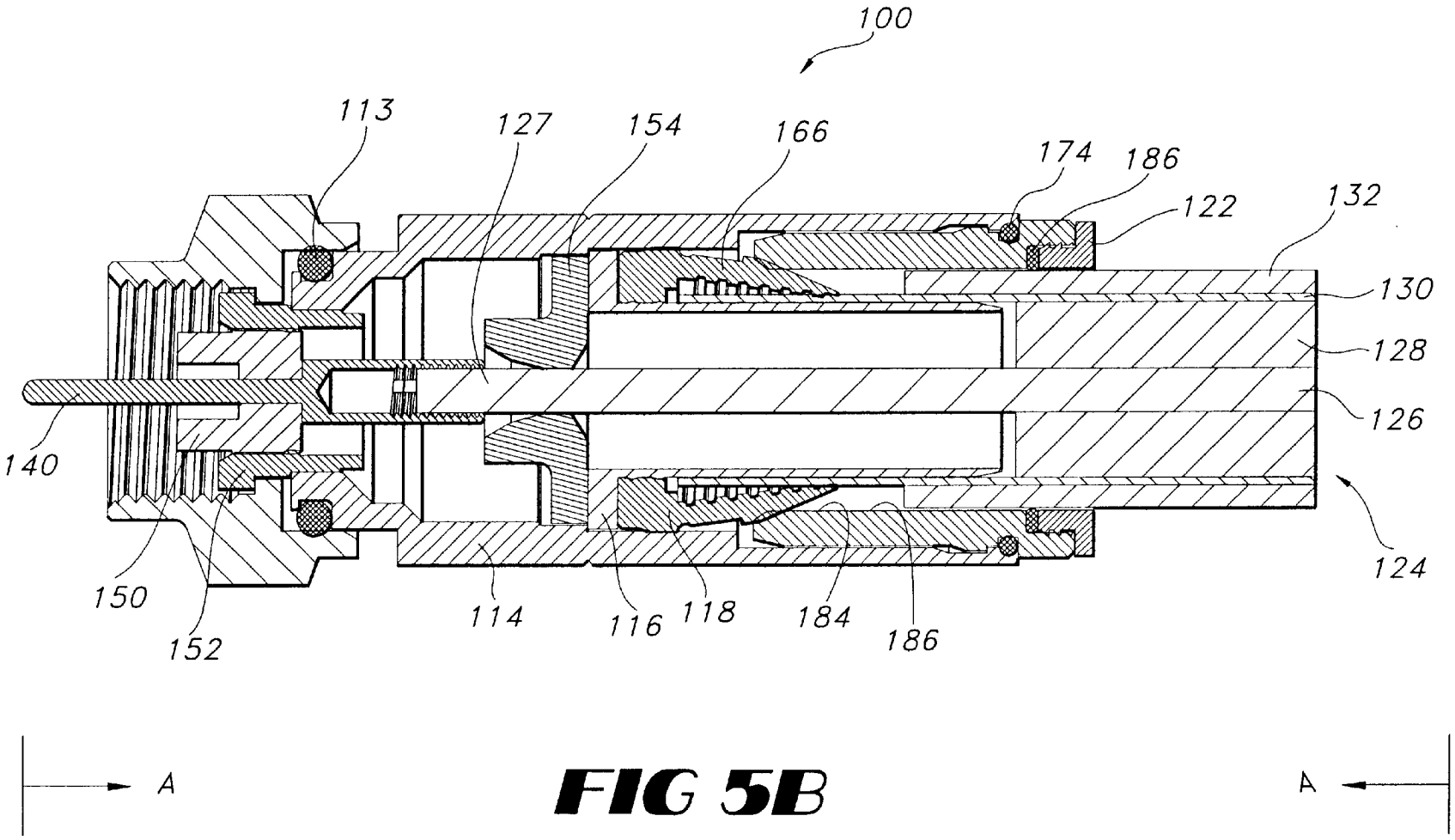
FIG. 5B is a cross-sectional view of the connector of FIG. 5A in a closed position.

The present invention is not limited to providing an environmental seal at the cable jacket by compressing a portion of the connector's sleeve. In another aspect of the present invention, as depicted in FIGS. 5A and 5B, an o-ring 186 is used to environmentally seal the connector 100 at the cable jacket 132. O-ring 186 comprises a resilient material, such as a synthetic rubber, an elastomeric polymer or a deformable plastic. FIGS. 5A and 5B are cross-sectional views of connector 100 in open and closed positions, respectively. In FIGS. 5A and 5B like components have like numbers as previously described.

Sleeve 120 has a notch 136 at its distal portion 134. Upon axial compression of connector 100, the proximal end 138 of seal ring 122 slidingly engages and compresses o-ring 186. Upon compression the o-ring 186 engages the cable jacket 132 to environmentally seal connector 100 thereat.

Figure 6:
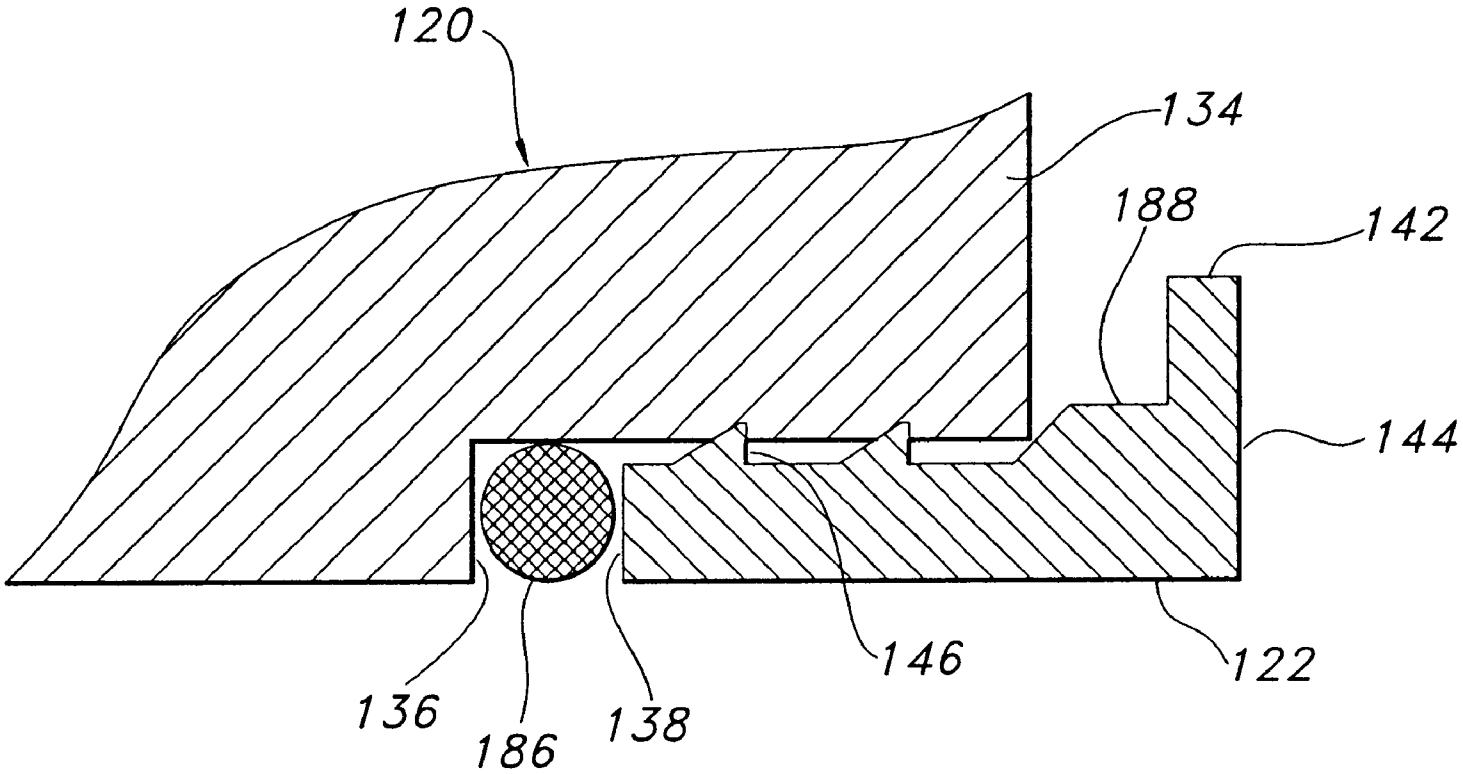
FIG. 6 is a partial cross-sectional view of the connector of FIG. 5A showing an arrangement of the sleeve, o-ring and seal ring.

In another aspect of the present invention, the seal ring 122 has a raised portion 188 near flange 142 as depicted in FIG. 6, which is a partial cross-sectional view of connector 100 detailing the arrangement of the sleeve 120 and the seal ring 122. The raised portion 188 is an interference that controls the force required to slidingly engage the seal ring 122 and the sleeve 120. The present invention, however, is not limited to the use of raised portion 188 for controlling the engagement force. Other parameters, such as the size of notch 136, the height of ribs 146, the size of o-ring 186 and the like, could be used to control the engaging force. Flange 142 acts as a positive stop to prevent over compressing the o-ring 186.

Various changes to the foregoing described structures and corresponding methods would now be evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. An environmentally-sealed, quick connect connector for use with a hard-line coaxial cable comprising:

an elongate post having a cylindrical wall with a proximal portion and a distal portion, the distal portion having an outer surface adapted to abuttingly engage an inner surface of an outer conductor of the hard-line coaxial cable;

a cylindrical ferrule having a proximal portion and a distal portion, the distal portion having a plurality of parted fingers having an inner surface adapted to abuttingly engage an outer surface of the outer conductor of the hard-line coaxial cable and a sloped outer surface;

a elongate cylindrical collar having a proximal end for securably holding the post and the ferrule and a distal open end;

a cylindrical sleeve having a proximal portion slidably engaging the sloped surface of the ferrule and a distal portion and having circumferential slot at the end thereof; and a seal ring adapted for slidingly insertion into the slot of the sleeve;

wherein upon the slidably insertion of the seal ring into the sleeve and the sleeve at the distal end of the collar, the proximal portion of the sleeve compresses the ferrule fingers radially inward to secure the inner surface of the fingers to the outer surface of the conductor and further wherein the seal ring radially inwardly compresses the distal portion of the sleeve onto an outer surface of a cable jacket which surrounds the outer conductor of the coaxial cable to provide an environmental seal thereat.

2. The connector of claim 1 further comprising an o-ring at the distal portion of the sleeve to environmentally seal the sleeve and the collar thereat upon sliding engagement of the sleeve and the collar.

3. The connector of claim 1 wherein the sleeve has a slanted inner surface at the proximal end to slidingly engage the sloped surface of the ferrule.

4. The connector of claim 1 wherein the inner surface of the ferrule fingers further comprise raised ridges extending inwardly to securable engage the outer conductor.

5. The connector of claim 1 further comprising nut and an o-ring within a distal portion of the nut to environmentally seal the nut and the collar thereat upon sliding engagement.

6. The connector of claim 1 further comprising raised teeth extending radially outward from the seal ring to securably hold the seal ring within the circumferential slot of the sleeve upon the sliding insertion of the seal ring into the sleeve.

7. The connector of claim 1 further comprising a notch at the distal end of the collar and a raised ridge at the distal end of the sleeve, wherein the notch and the raised ridge are defined to engage upon sliding engagement of the sleeve and the collar to securably fix secure the sleeve to the collar thereat.

8. The connector of claim 1 wherein the connector is a RF connector.

9. An environmentally-sealed, quick connect connector for use with a hard-line coaxial cable comprising:

an elongate post having a cylindrical wall with a proximal portion and a distal portion, the distal portion having an outer surface adapted to abuttingly engage an inner surface of an outer conductor of the hard-line coaxial cable;

a cylindrical ferrule having a proximal portion and a distal portion, the distal portion having a plurality of parted fingers having an inner surface adapted to abuttingly engage an outer surface of the outer conductor of the hard-line coaxial cable and a sloped outer surface;

a elongate cylindrical collar having a proximal end for securably holding the post and the ferrule and a distal open end;

a cylindrical sleeve having a proximal portion slidably engaging the sloped surface of the ferrule and a distal portion having circumferential notch at the end thereof;

an o-ring positioned within the notch of the sleeve; and a seal ring adapted for slidingly insertion into the notch of the sleeve;

wherein upon the slidably insertion of the seal ring into the sleeve at the distal end of the collar, the proximal portion of the sleeve compresses the ferrule fingers radially inward to secure the inner surface of the fingers to the outer surface of the conductor and further wherein the seal ring compresses the o-ring onto an outer surface of a cable jacket which surrounds the outer conductor of the coaxial cable to provide an environmental seal thereat.

10. The connector of claim 9 further comprising a second o-ring at the distal portion of the sleeve to environmentally seal the sleeve and the collar thereat upon sliding engagement of the sleeve and the collar.

11. The connector of claim 9 wherein the sleeve has a slanted inner surface at the proximal end to slidingly engage the sloped surface of the ferrule.

12. The connector of claim 9 wherein the inner surface of the ferrule fingers further comprise raised ridges extending inwardly to securable engage the outer conductor.

13. The connector of claim 9 further comprising nut and a third o-ring within a distal portion of the nut to environmentally seal the nut and the collar thereat upon sliding engagement.

14. The connector of claim 9 further comprising raised teeth extending radially outward from the seal ring to securably hold the seal ring within the notch of the sleeve upon the sliding insertion of the seal ring into the sleeve.

15. The connector of claim 9 further comprising a second notch at the distal end of the collar and a raised ridge at the distal end of the sleeve, wherein the second notch and the raised ridge are defined to engage upon sliding engagement of the sleeve and the collar to securably fix secure the sleeve to the collar thereat.

16. The connector of claim 9 wherein the connector is a RF connector.

17. An environmentally-sealed, electrical connection comprising:

a hard-line coaxial cable having an elongate center conductor, a dielectric surrounding the center conductor, a tubular outer conductor encompassing the dielectric and a cable jacket covering the outer conductor;

an elongate post having a cylindrical wall with a proximal portion and a distal portion, the distal portion having an outer surface adapted to abuttingly engage an inner surface of the outer conductor of the hard-line coaxial cable;

a cylindrical ferrule having a proximal portion and a distal portion, the distal portion having a plurality of parted fingers having an inner surface adapted to abuttingly engage an outer surface of the outer conductor of the hard-line coaxial cable and a sloped outer surface;

a elongate cylindrical collar having a proximal end for securably holding the post and the ferrule and a distal open end;

a cylindrical sleeve having a proximal portion slidably engaging the sloped surface of the ferrule and a distal portion having a sealing device at the end thereof; and a seal ring adapted for slidingly insertion into the slot of the sleeve; wherein upon the slidably insertion of the seal ring into the sleeve at the distal end of the collar, the proximal portion of the sleeve compresses the ferrule fingers radially inward to secure the inner surface of the fingers to the outer surface of the conductor and further wherein the seal ring compresses the sealing device onto an outer surface of the cable jacket to provide an environmental seal thereat.

18. The connection of claim 17 further comprising an o-ring at the distal portion of the sleeve to environmentally seal the sleeve and the collar thereat upon sliding engagement of the sleeve and the collar.

19. The connection of claim 17 wherein the sleeve has a slanted inner surface at the proximal end to slidingly engage the sloped surface of the ferrule.

20. The connection of claim 17 wherein the inner surface of the ferrule fingers further comprise raised ridges extending inwardly to securable engage the outer conductor.

21. The connection of claim 17 wherein the distal portion of the sleeve has a notch portion thereat and the sealing device is an o-ring contained within the notch portion.

22. The connection of claim 17 wherein the distal portion of the sleeve has a circumferential slot thereat to define an inner portion of the sleeve and the sealing device is the inner portion of the sleeve which is radially and inwardly compressed upon sliding insertion of the sleeve into the seal ring.

23. The connection of claim 17 further comprising raised teeth extending radially outward from the seal ring to securably hold the seal ring within the circumferential slot of the sleeve upon sliding insertion of the seal ring into the sleeve.

24. The connection of claim 17 further comprising a notch at the distal end of the collar and a raised ridge at the distal end of the sleeve, wherein the notch and the raised ridge are defined to engage upon sliding engagement of the sleeve and the collar to securably fix secure the sleeve to the collar thereat.

25. The connection of claim 17 wherein the connector is a RF connector.

26. The connection of claim 17 wherein the cable jacket is formed from a deformable material.

27. A connector for use with a coaxial cable comprising:

an elongate post having a cylindrical wall with a proximal portion and a distal portion, the distal portion having an outer surface adapted to abuttingly engage an inner surface of an outer conductor of the hard-line coaxial cable;

a parted and cylindrical ferrule having a proximal portion and a distal portion, the distal portion having an inner surface adapted to abuttingly engage an outer surface of the outer conductor of the hard-line coaxial cable and a sloped outer surface;

a elongate cylindrical collar having a proximal end for securably holding the proximal portion of the post and the proximal portion of the ferrule and a distal open end;

a cylindrical sleeve having a proximal portion circumferentially engaging the sloped surface of the ferrule and a distal portion having an open end and having a cylindrical notch;

a hollow cylindrical seal adapted for securement within the notch; and an o-ring positioned within the notch of the sleeve;

wherein upon secure engagement of the cylindrical sleeve and the distal end of the collar, the proximal portion of the sleeve compresses the ferrule radially inward to secure the inner surface of the ferrule to the outer surface of the conductor and further wherein the o-ring compresses onto an outer surface of a cable jacket which surrounds the outer conductor of the coaxial cable to provide an environmental seal thereat.

28. The connector of claim 27 further comprising a second o-ring for providing an environmental seal between the collar and the cylindrical sleeve upon secure engagement of the collar and the cylindrical sleeve.

29. The connector of claim 27 wherein the inner surface of the ferrule further comprise raised ridges extending inwardly to securable engage the outer conductor.

30. The connector of claim 27 further comprising a nut and a third o-ring within a distal portion of the nut to environmentally seal the nut and the collar thereat upon secure engagement of the nut and the collar.

31. The connector of claim 27 wherein the sleeve has a slanted inner surface at the proximal end to engage the sloped surface of the ferrule.

* * * * *